United States Patent [19]

Jou

[11] Patent Number: 5,040,786

[45] Date of Patent: Aug. 20, 1991

[54] REHABILITATION DEVICE

[76] Inventor: W. K. Jou, No. 357, Sec. 3 San-Ming Rd., Taouyan City, Taiwan

[21] Appl. No.: 520,799

[22] Filed: May 8, 1990

[51] Int. Cl.[5] ..... A63B 21/02

[52] U.S. Cl. ..... 272/70; 272/96; 272/141

[58] Field of Search ..... 272/70, 141, 142, 69, 272/96, 97, 93; 128/25 R, 25 B

[56] References Cited

U.S. PATENT DOCUMENTS

| | | | |
|---|---|---|---|
| 3,628,791 | 12/1971 | Garcia | 272/141 |
| 4,726,580 | 2/1988 | Batiste et al. | 272/141 |
| 4,900,012 | 2/1990 | Fu | 272/70 |

*Primary Examiner*—Stephen R. Crow
*Attorney, Agent, or Firm*—Larson and Taylor

[57] ABSTRACT

A rehabilitation device has an elongate frame with a front frame portion and a rear frame portion. The frame rear portion has first and second transversely spaced apart side portions which each include an upper and a lower tubular frame member. A transversely disposed axle is rigidly mounted between the frame side portions and in turn pivotally mounts two shaft sleeves. A longitudinally extending connecting rod is rigidly connected at one end thereof to one end of each shaft sleeve and a depending driving rod is rigidly connected at one end thereof to the other end of each sleeve at a vertical angle with said connecting rod of approximately 90 degrees. The other end of the connecting rod supports a foot pedal and the other end of the driving rod is connected to a tension rod. The tension rod includes a compressible spring and is mounted inside a bore in the lower frame member.

21 Claims, 4 Drawing Sheets

REHABILITATION DEVICE

FIELD OF THE INVENTION

This invention relates generally to a rehabilitation device, and more particularly to a rehabilitation device for feet.

SUMMARY OF THE INVENTION

The present invention in a specific embodiment utilizes a connecting rod and a shaft, in which a shaft tube is coupled to the front part of the connecting rod at one end, is inserted onto the shaft, and with another end connecting to a driving rod at a vertical angle facing downward with the connecting rod. A foot pedal, fitted to the rearward end of the connecting rod, can be moved upwardly and downwardly about an axis defined by the shaft, therefore the connecting rod will drive the driving rod connected integrally with the connecting rod at a vertical angle to move a round arc on shaft center of shaft. The lower part of said driving rod is connected with tension rod protruding at the end of lower tubular frame, the said tension rod will simultaneously be driven to move toward the direction of front tubular frame when the driving rod moves in a round arc. As the driving rod positioned at shaft is limited by said tension rod, the position of the connecting rod relative to the shaft will not be changed.

BRIEF DESCRIPTION OF THE DRAWINGS

The preferred embodiment of the present invention is described with reference to the accompanying drawings in which.

DESCRIPTION OF THE PREFERRED EMBODIMENTS

Figure 1:
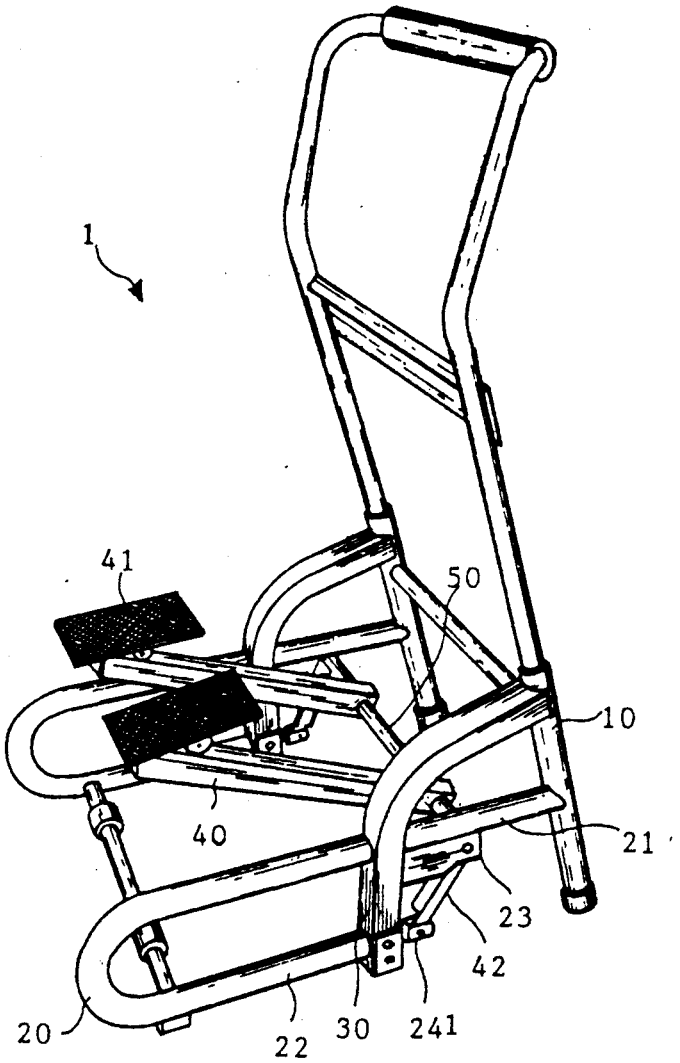
FIG. 1 shows in perspective a rehabilitation device.
Figure 2:
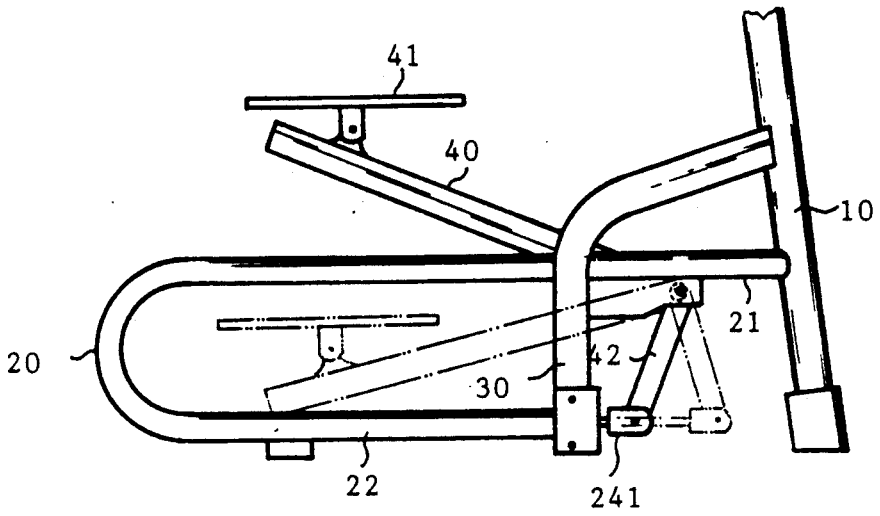
FIG. 2 shows how the components of the rehabilitation device operate with each other, and shows the upward and downward movement of the tension rod.
Figure 3:
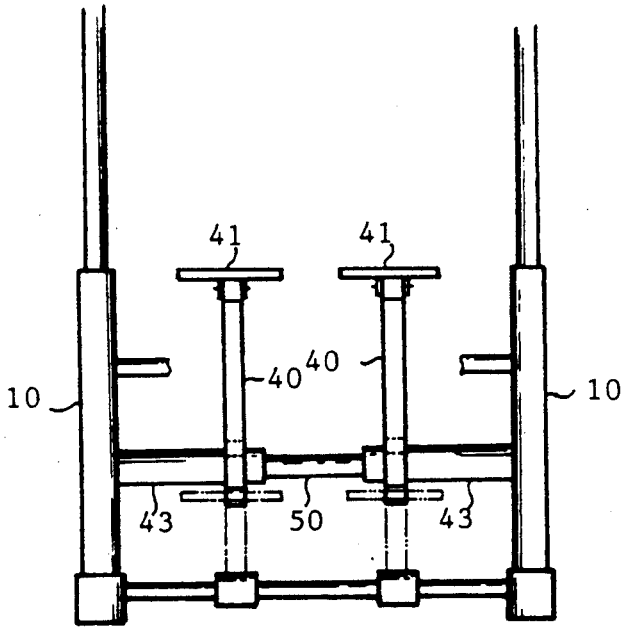
FIG. 3 shows a front view of FIG. 2.

With reference to the drawings, FIGS. 1, 2, and 3 show the foot pedal 41 of rehabilitation device 1 and the connecting rod 40 in conjunction with the foot pedal 41 fitted on the left and right of tubular 20 and within the scope around the front tubular frame 10. Accordingly, at the bottom position of the upper tubular frame 21 in between the left and right tubular frame 20, a shaft 50 serving as the shaft axis for the front part of the above mentioned connecting rod 40 is arranged horizontally, enabling its tail member to move upwardly and downwardly.

Figure 5:
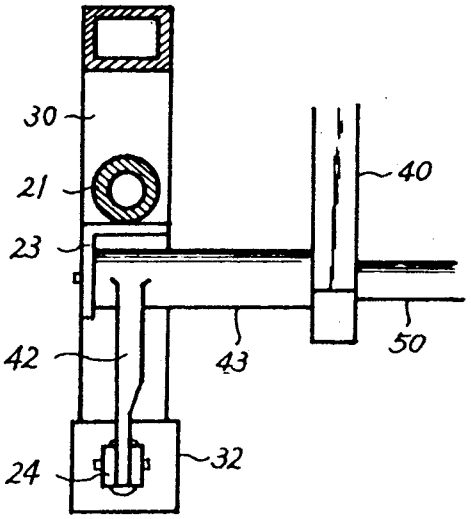
FIG. 5 shows how the elements of shaft, connecting rod, driving rod, tension rod and vertically established square support tube connect with each other.
Figure 4:
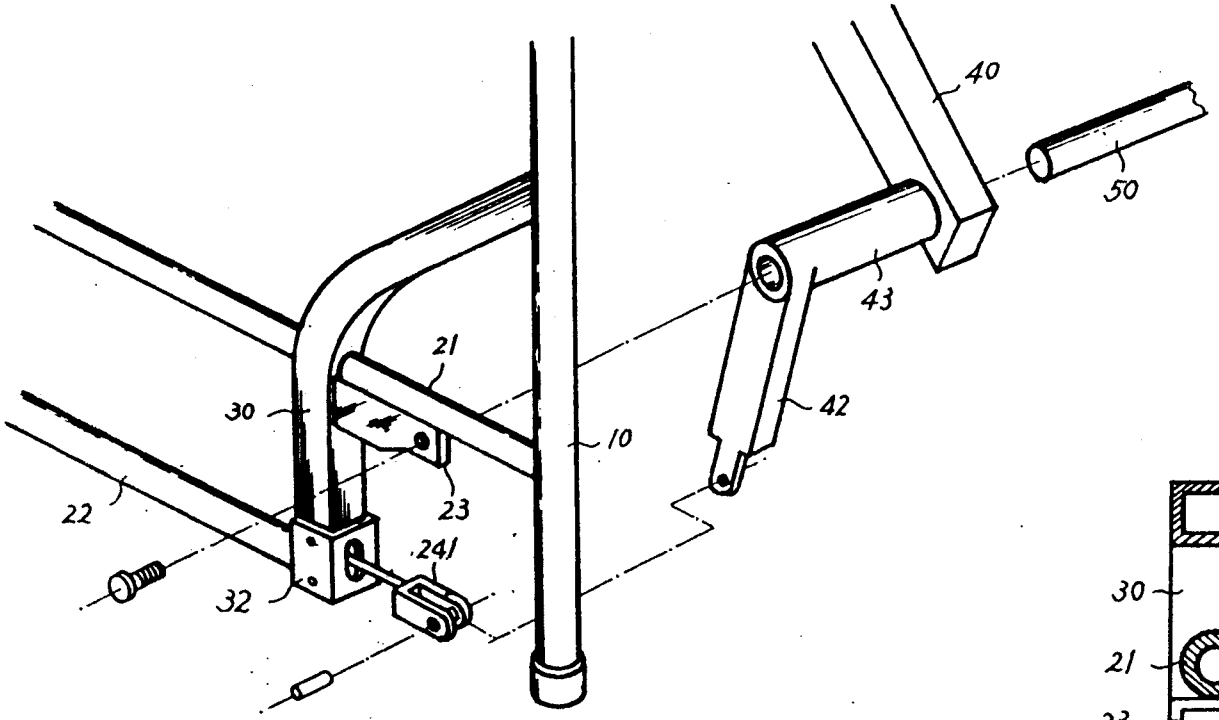
FIG. 4 shows how the two elements of the connecting rod and the shaft are assembled to each other.

Referring to FIGS. 4 and 5, for relevant detailed structures of above connecting rod 40 and shaft 50, a reinforced plate 23 is positioned vertically at the low side of upper tubular frame 21 in between the vertically established square support tube 30 and front tubular frame 10. Thereby, the above horizontally arranged shaft 50 may be fixed firmly in between the above left and right tubular frame 20 with the aid of reinforced plate 23; besides, a shaft tube 43, which is coupled to the front part of above connecting rod 40 in one end, is inserted in above shaft 50, with another end connecting to a driving rod 42 in approximate 90 degree vertical angle facing downward with above connecting rod 40. The foot pedal 41, fitted the end of connecting rod 40, can move upwardly and downwardly using the shaft 50 as shaft axis by means of above mechanism. The results of upward and downward movement by above connecting rod 40 will drive the driving rod 42, connected integrally with the connecting rod 40 in vertical angle, to move a round arc on strength of the shaft center of shaft 50. Furthermore, the lower part of above driving rod 42 is connected with the tension rod 24 protruding at the front end of lower tubular frame 22, when the above driving rod 42 moves a round arc using the shaft 50 as shaft center, the above tension rod 24 will simultaneously be driven to move toward the direction of front tubular frame 10. As the driving rod 42, positioned at the shaft 50 is limited by the tension rod 24, the position of the connecting rod 40 relative to shaft 50 will not be changed.

Figure 6:
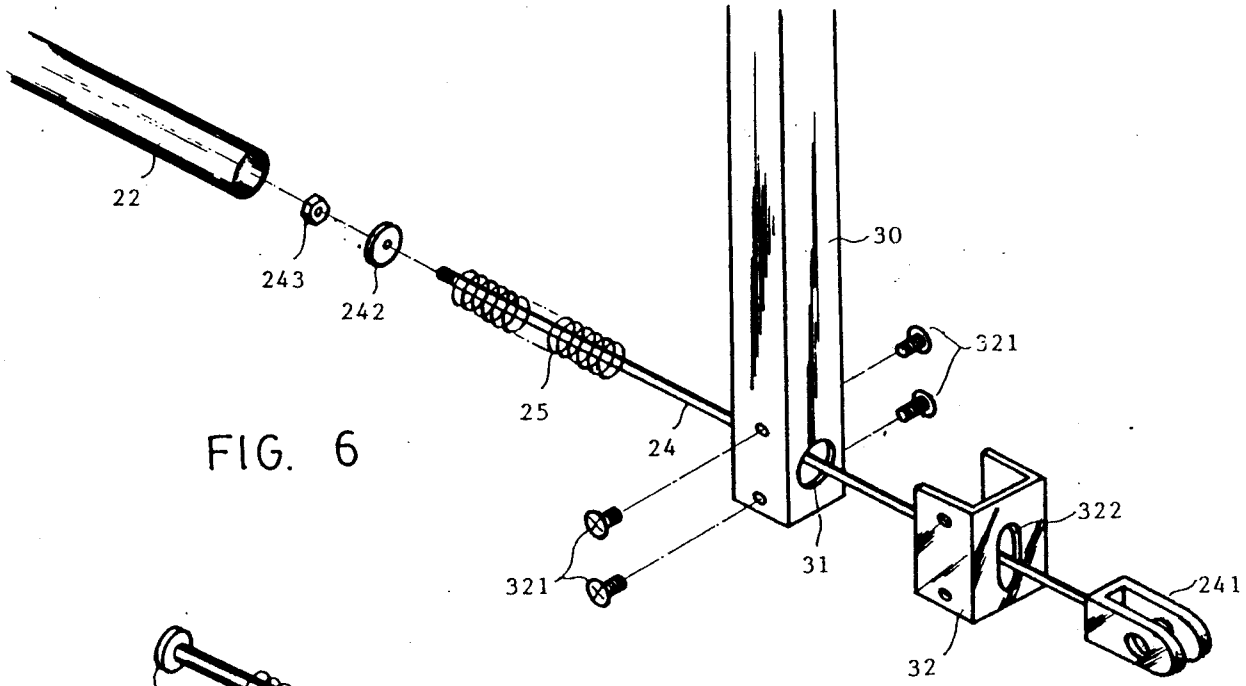
FIG. 6 shows how the elements of vertically established square support tube, compression spring, lower tubular frame, and tension rod are assembled to each other.

Again, the relevant mechanism of tension rod 24, as shown in FIG. 6, is a long piece shape rod built in the low tubular frame 22, with a compression spring 25 smaller than the low tubular frame 22 in diameter covered in tension rod 24. Furthermore, the front end of tension rod 24 is coupled to a rod head 241, which is connected with driving rod 42, with its tail end inserted in the inner damper 242 having a diameter smaller than the internal diameter of low tubular frame 22. The inner damper 242 can be pushed through the front screw and rear screw at the end of tension rod 24 so as to adjust elasticity of spring 25 by adjusting screw 243.

Figure 7:
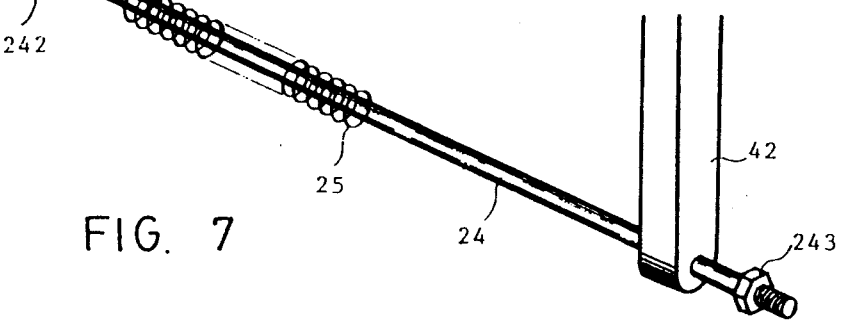
FIG. 7 denotes the other application of FIG. 6 of the embodiments.

Again, a piercing hole 31 is located at the low part of vertically established square support tube 30, in which end part of low tubular frame is inserted and fixed firmly by welding. Again, a hollow grooved shaped external damper 32 is mounted on the surrounding wall of piercing hole 31 of square support tube 30 and the external damper 32 is fixed fast at the low part of square support tube 30 by screw 321. Again, the external damper 32, to which a square support tube 30 is closely attached, has a long hole 322 in the center of a circle of the piercing hole 31 located at square support tube 30, with the long diameter of the long hole 322 larger than or equal to the external diameter of low tubular frame 22 and the short diameter smaller than the diameter of above spring 25. By means of the above mechanism, when the rod head 241 of tension rod 24 is driven moving ahead in the direction of tubular frame 10 by driving rod 42, the inner damper 242 at the tail end of tension rod 24 will push spring 25 to shift in the same direction. But the front end of spring 25, limited by the external damper 32, will keep the spring 25 gradually to a state of being compressed. If the force acting on the tension rod 24 disappears, the tension rod 24, influenced by the restoration of elasticity of compressed spring 25, will restore to the original position. The adjustment for restoring the elasticity for spring 25 may be made by means of adjusting screw 243 fitted at the tail end of tension rod 24. Another preferred embodiment is that above adjusting spring 25 can also fix the inner damper 242 in a fixed way as shown in FIG. 7. In case the adjusting screw 243 is shifted to the front end, then it will be easier for the operator to adjust by themselves in accordance with the convenient adjustment to the elasticity.

The object of the design of the long hole 322 of external damper 32 is to limit the front end of spring 25 by the short diameter of long hole 322, causing the compression of spring 25 (already explained previously). However, the long diameter of long hole 322 moves within round arc by means of shaft 50 coupled to the driving rod 42 moved by tension rod 24, therefore, the tension rod 24 moves slightly upward and downward in addition to moving slightly toward the direction of front tubular frame 10. Thus, the long diameter of long hole 322 of the external damper 32 provides abundant space for the upward and downward movement of tension rod 24.

By means of the above mechanism when the feet of the operator stand on the foot pedal 41 of the rehabilitation device 1 and operate it by walking with the center shifting toward one of the foot pedals 41, then the low connecting rod 40 of the foot pedal 41, affected by gravity, is moving downward following the shaft 50 and connecting integrally with the connecting rod 40, and the driving rod 42 assuming in a mutual 90 degree posture is rotating following the shaft 50. With this action, the tension rod 24 is driven to move toward the direction of front tubular frame 10, bringing the built-in spring 25 inside the tubular frame to be compressed. Again, above another foot pedal 41, bearing no weight of operator, will act the compressed spring 25 to restore the tension rod 24 to original position, namely, shoving the driving rod 42 and connecting rod 40 to the original position and thereby the feet of the operator standing on the foot pedals 41 will be raised through the restored strength of foot pedals 41. The repeated operation in such walking way will achieve effectively the object of rehabilitation on feet for rehabilitator.

This invention is, of course, not limited to the above exemplified embodiment, but can be modified within the scope of the following claims.

I claim:

1. A rehabilitation device comprising a frame having a tubular front portion and a tubular rear portion, said rear portion having first and second transversely spaced apart tubular side portions, and each said side portion has an upper tubular frame member, a lower tubular frame member which has a bore therein, a vertically oriented square support tube, and a reinforcing plate dependingly mounted to the bottom side of said upper frame member in between said square support tube and said front portion;

a horizontally disposed shaft rigidly mounted to said first and second frame side portions, said shaft defining an axis of rotation;

a shaft sleeve pivotally mounted about said shaft;

a connecting rod rigidly mounted at the forward end thereof to an end portion of said shaft sleeve;

a foot pedal mounted to the rearward end of said connecting rod such that said rearward end of said connecting rod can be moved thereby in an upward and a downward direction;

a depending driving rod fixedly connected at one end thereof to the other end portion of said shaft sleeve at an approximate 90 degree angle in a vertical plane with respect to said connecting rod such that when said foot pedal moves said rearward end of said connecting rod, said driving rod will be pivoted about a circular arc in a vertical plane;

a tension rod having a forward end and a tail end, said tension rod being mounted in said lower frame member bore for movement in a forward and rearward longitudinal direction and having its forward end protruding from the forward end of said lower frame member, said other end of said driving rod being connected to said protruding forward end such that when said connecting arm rearward end moves downwardly and pivots said shaft sleeve, said driving rod in turn will be pivoted in a circular arc and said tension rod will be moved in a forward longitudinal direction toward said front frame portion, said tension rod limiting the circular movement of said driving rod, but said driving rod longitudinal position with respect to said shaft will not be changed.

2. The rehabilitation device as claimed in claim 1 wherein said tension rod includes a rod head mounted at the forward end thereof, said driving rod being connected to said rod head, and said tension rod includes an inner stopper which receives said tail end of said tension rod.

3. The rehabilitation device as claimed in claim 2 wherein said inner stopper has a diameter smaller than the internal diameter of said lower frame member bore.

4. The rehabilitation device as claimed in claim 1 wherein said tension rod comprises an elongate rod member, an elongate compression spring mounted about said rod member and having a diameter smaller than the internal diameter of said lower frame member bore.

5. The rehabilitation device as claimed in claim 4 wherein a lower portion of said square support tube has a hole therethrough; and wherein said lower frame member extends through said hole and is fixedly attached to said square support tube.

6. A rehabilitation device comprising:

an elongate frame having a front portion and a rear portion, said rear portion having first and second transversely spaced apart side portions, and each side portion has an upper frame member, a lower tubular frame member which extends in the longitudinal direction, and mounting means;

a transversely disposed axle rotatably mounted by said frame mounting means, said axle defining an axis of rotation;

a connecting bar mounted at a forward end thereof to said axle for rotation about said axis of rotation and extending rearwardly therefrom to a rearward end, a foot pedal mounted to said rearward end;

a depending driving bar fixedly mounted at one end thereof to said connecting bar forward end at an angle therewith in a vertical plane such that when said foot pedal of said connecting bar moves in a vertical plane, said driving bar is pivoted about a circular arc in a vertical plane;

a tension bar having a forward end and a tail end, said tension bar being mounted to said lower frame member for reciprocal movement in the longitudinal direction with respect thereto, said forward tension bar end connected to the other end of said driving bar, said tension bar limiting and providing a resistance to the pivoting of said driving bar.

7. The rehabilitation device as claimed in claim 6 wherein said axle comprises a horizontally disposed shaft rigidly mounted to said first and second frame mounting means, and a pivoting bar pivotally mounted to said shaft; said connecting bar being rigidly mounted to said pivoting bar.

8. The rehabilitation device as claimed in claim 7 wherein said pivoting bar comprises a shaft sleeve pivotally mounted around said shaft; wherein said connecting bar is rigidly mounted to one end portion of said shaft sleeve; and wherein said driving bar is rigidly mounted to the other end portion of said shaft sleeve at an approximate 90 degree angle to said connecting bar.

9. The rehabilitation device as claimed in claim 6 wherein said frame front portion is comprised of tubular members, including two upright, transversely spaced apart posts which engage the supporting surface for the device; wherein said frame side portions are comprised of tubular members; and wherein each said upper frame member is connected to the corresponding one of said posts.

10. The rehabilitation device as claimed in claim 9 wherein each said frame side portion further comprises a support tube connected at one end thereof to the corresponding one of said posts and which engages the supporting surface for said device at the other end thereof, said support tube having a substantially vertical lower portion which includes said support tube other end and a longitudinally extending upper portion which includes said support tube one end.

11. The rehabilitation device as claimed in claim 10 wherein said support tube lower portion has a longitudinally extending bore completely therethrough; and wherein said lower frame member extends into said support tube bore and is fixedly attached to said support tube.

12. The rehabilitation device as claimed in claim 11 wherein said upper and lower frame members comprise the respective upper and lower legs of a U-shaped tubular member that are in the same vertical plane, said upper frame member extending completely through a second, upper bore located in the upper end of said support tube lower portion.

13. The rehabilitation device as claimed in claim 11 wherein said side portions mounting means each comprises a reinforcing plate dependingly mounted to said upper frame member in between said support tube and said front portion post.

14. The rehabilitation device as claimed in claim 11 wherein said lower frame member has a bore therein;

and wherein said tension bar is mounted in said lower frame member bore for reciprocal movement therein in the longitudinal direction, said forward tension bar end protruding from the forward end of said lower frame member.

15. The rehabilitation device as claimed in claim 14 wherein said tension bar includes a rod head mounted at the forward end thereof, said driving bar being connected to said rod head, and said tension rod includes an inner stopper which receives said tail end of said tension rod, said inner stopper having a diameter smaller than the internal diameter of said lower frame member bore.

16. The rehabilitation device as claimed in claim 15 wherein each said frame side portion further comprises a support tube connected at one end thereof to said frame front portion and which engages the supporting surface for said device at the other end thereof, said support tube having a substantially vertical lower portion which includes said support tube other end and a longitudinally extending upper portion which includes said support tube one end; and wherein said tension bar further includes an elongate rod member on which is said inner stopper is mounted and an elongate compression spring mounted about said rod member and having a diameter smaller than the internal diameter of said lower frame member bore, one end of said spring being confined by said inner stopper and the other end of said spring being confined by said lower portion of said support tube.

17. The rehabilitation device as claimed in claim 16 wherein said support tube lower portion has a longitudinally extending bore completely therethrough; and wherein said lower frame member extends into said support tube bore and is fixedly attached to said support tube;

wherein said support tube further includes an outer stopper mounted over said support tube bore and has a hole therethrough in registry with said support tube bore;

and wherein the transverse diameter of said outer stopper hole is smaller than the diameter of said spring, said spring other end being confined by said outer stopper.

18. The rehabilitation device as claimed in claim 17 wherein said outer stopper hole is elongate, the longer diameter extending in the vertical direction and the short diameter extending in the transverse direction, said elongate hole permitting a vertical movement of said tension bar as said tension bar moves longitudinally.

19. The rehabilitation device as claimed in claim 16 wherein said tension bar further includes means for adjusting the compression of said spring.

20. The rehabilitation device as claimed in claim 19 wherein said tension bar forward end has threads thereon; and wherein said adjusting means comprises a nut threaded onto said threads.

21. The rehabilitation device as claimed in claim 19 wherein said tension bar tail end has threads thereon;

wherein said inner stopper can slide on said elongate rod member; and wherein said adjusting means comprises a nut threaded onto said threads, said nut engaging said inner stopper.

* * * * *